United States Patent [19]

Jeschke

[11] Patent Number: 4,886,261

[45] Date of Patent: Dec. 12, 1989

[54] SHEET FEEDER FOR A PRINTING MACHINE

[75] Inventor: Willi Jeschke, Bad Herrenalb, Fed. Rep. of Germany

[73] Assignee: Heidelberger Druckmaschinen AG, Heidelberg, Fed. Rep. of Germany

[21] Appl. No.: 160,400

[22] Filed: Feb. 25, 1988

[30] Foreign Application Priority Data

Feb. 25, 1987 [DE] Fed. Rep. of Germany ..... 3706058

[51] Int. Cl.[4] ..... B65H 5/08; B65H 3/08; B65H 3/46

[52] U.S. Cl. ..... 271/11; 271/15; 271/98; 271/105; 271/147; 271/250

[58] Field of Search ..... 271/5, 11, 14, 90, 93, 271/97, 98, 105, 107, 108, 30.1, 15, 226, 250, 243, 245, 145, 167, 169, 171

[56] References Cited

U.S. PATENT DOCUMENTS

| | | | |
|---|---|---|---|
| 2,233,935 | 3/1941 | Backhouse | 271/98 |
| 3,022,997 | 2/1962 | Pendley | 271/171 |
| 3,695,606 | 10/1972 | Wirz | 271/26 R |
| 3,809,389 | 5/1974 | Wirz | 271/93 |
| 3,938,800 | 2/1976 | Wirz | 271/93 |
| 4,470,589 | 9/1984 | Singer | 271/98 |
| 4,568,073 | 2/1986 | VanHorne | 271/98 |

*Primary Examiner*—Joseph J. Rolla
*Assistant Examiner*—Steven M. Reiss
*Attorney, Agent, or Firm*—Herbert L. Lerner; Laurence A. Greenberg

[57] ABSTRACT

Sheet feeder for a printing machine includes a receiving device adjustable in height for taking up a pile formed of individual sheets, a front stop for leading edges of the sheets, and at least one side stop for the side edges of the sheets at one side of the pile; alignment elements located at least at an upper end of the pile and exerting alignment forces on the pile towards the front and the side stops; a loosening device for neutralizing, at least partly, adherence of the upper sheets to one another; a conveying device for withdrawing the respective uppermost sheet from the pile and feeding it into the printing machine; and an additional sheet alignment device acting upon the surface of the respective uppermost sheet, at least until it is taken over by the conveying device, in a way that the alignment device exerts alignment forces upon the sheet towards at least one of the stops; the additional sheet alignment device being offset with respect to the conveying device towards respective trailing edges of the sheets.

8 Claims, 2 Drawing Sheets

SHEET FEEDER FOR A PRINTING MACHINE

Figure 1:
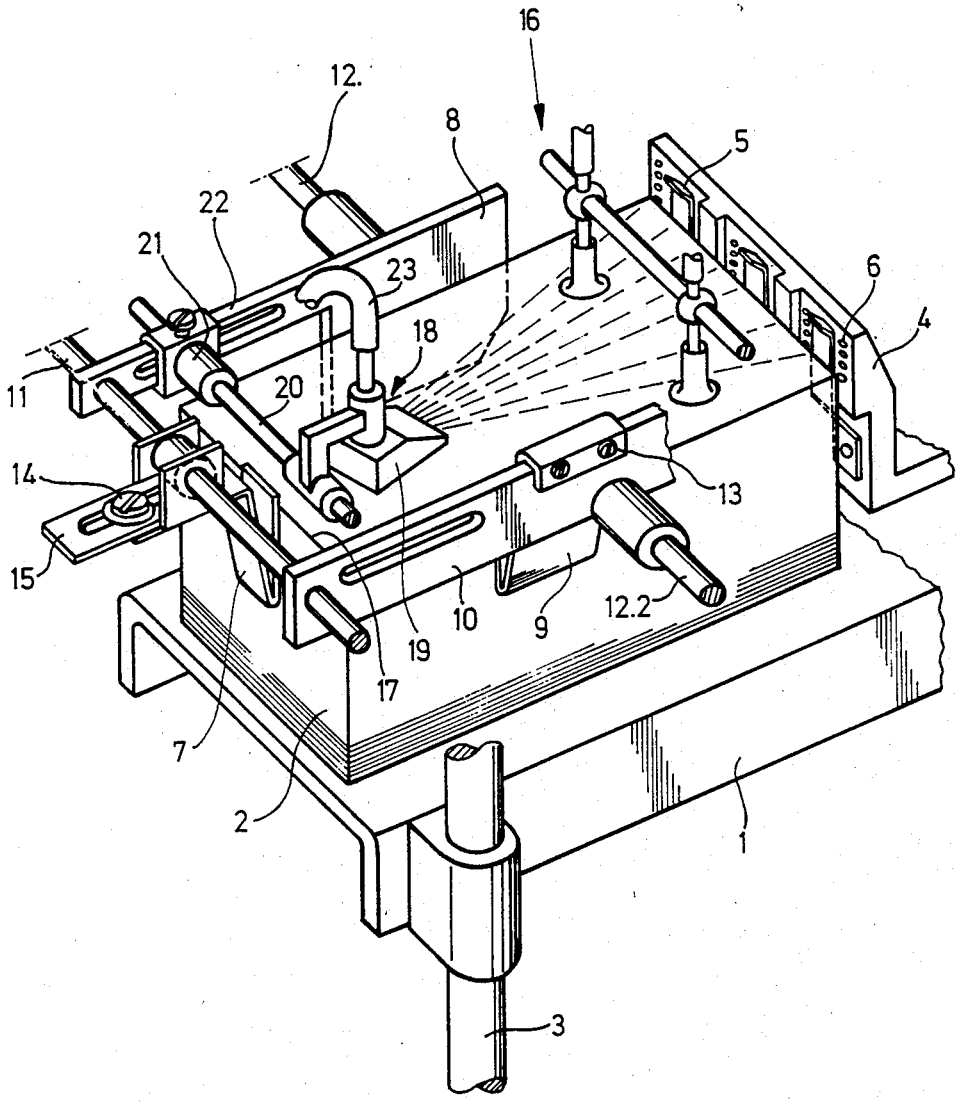

The invention relates to a sheet feeder for a printing machine.

A sheet-fed offset printing machine is generally equipped with a sheet feeder having a receiving device adjustable in height for a sheet pile. For the printing operation the sheets are individually withdrawn from the pile and fed to the printing machine. Before being drawn into the printing unit, the sheets are aligned at the leading edge thereof and at one side edge.

There are essentially two different feeding systems which are used for sheet alignment.

In a first system, the sheets lie on a pile table which is adjustable in height, without any stop means being provided for the sides of the pile. Especially, in the case of high-speed printing machines, this pile table is displaceable in transverse direction by means of a servosystem, for the purpose of effecting a lateral coarse alignment of the sheets to be withdrawn. The direction and length of the respective, necessary follow-up travel path are determined by a sensing unit positioned at the upper end of a side of the pile.

After having separated and picked-up or withdrawn the respective uppermost sheet, a fine alignment thereof takes place. For this purpose, the picked-up sheet is fed onto a feed table by conveying means so as to abut against front lays as well as against the side lays of a side pulling device.

Such feed tables are arranged between the sheet pile and the printing unit, thereby essentially influencing the total construction length of the printing machine.

In a second feeding system the sheets lie, in fact, also on a pile table which is adjustable in height; however, the pile table is part of a receiving or take-up device having a front stop for the respective leading edges of the sheets and at least one side or lateral stop for the side edges of the sheets on side of the pile. Furthermore, at least at the upper end of the pile, alignment elements, usually in the form of leaf springs, are arranged and exert alignment forces on the pile in a direction towards the front and the side stops.

Conveying means are, in turn, provided for withdrawing the respective uppermost sheet and feeding it into the printing machine. The conveying means, however, do not convey the withdrawn sheet to an alignment run for which, in the aforementioned system, a feed table with front lays and a side pulling device were provided, but rather, deliver the sheet being conveyed directly to infeed rollers of the printing machine.

In this case, the absence or omission of a feed table permits a compact form of construction of the printing machine.

In this system, at least the lateral or side alignment of the sheets is limited, however, to the extent attainable by the alignment elements directly acting on the sheet pile. For certain specific applications this would be sufficient.

This system is of practical use mainly for small offset printing machines.

German Published Non-Prosecuted Application DE-OS 32 10 942 discloses a device for lateral alignment of the uppermost sheet of a pile; this device, likewise, operates without stop means for the side edges of the sheet pile, however, it does not have a feed table arranged between the pile and the sheet-feeding means for effecting lateral alignment of the sheet.

In this respect the last-mentioned device thus deviates from the "first" system, but it has means which permit lateral sheet alignment in the immediate proximity of the pile. This lateral sheet alignment is affected by a conveying device which withdraws the respective uppermost sheet of the pile and transports it to an alignment position at a distance laterally from the pile, the sheet being releasable from the conveying device in that alignment position. For this purpose, the sheet is gripped at its surface by the conveying device and brought into abutment with a side stop in the lateral alignment position.

Such a device, indeed, permits the attainment of the relatively short total construction length of the printing machine with the "second" system; however, in view of the efforts made or expense incurred for the laterally operating conveying device and the necessary provisions for the releasability of the laterally aligned sheet from this conveying device, this alignment method is inferior to the method according to the "second" system which, at least with respect to the lateral sheet alignment, functions with simple stops for the lateral alignment of the pile.

For greater demands, especially as to the lateral sheet alignment, this "second" system, however, has proven to be unsuitable. Faultless functioning thereof can be impaired, for example, if the pile contains sheets of undersized width.

Because the alignment elements, which are mostly constructed as leaf springs and which act laterally on the pile, extend over a number of sheets at the upper pile end, such sheets are not subjected to the alignment action of these alignment elements to the required extent.

In the "second" system, blowing air is fed to the upper end of the pile side facing towards the printing machine for the purpose of separating the sheets. Non-uniform yielding or falling-back of the leading sheet edge, which may possibly result in this connection, can have an undesirable effect upon the alignment of this sheet edge, which can be, even more so, when a sensing bar is applied to the pile surface for sensing the height of the pile.

It is accordingly an object of the invention to provide an improved sheet feeding system of a printing machine which operates with alignment elements for aligning the sides of a sheet pile so that it meets increased sheet alignment demands.

With the foregoing and other objects in view, there is provided, in accordance with the invention, a sheet feeder for a printing machine comprising a receiving device adjustable in height for taking up a pile formed of individual sheets, a front stop for leading edges of the sheets, and at least one side stop for the side edges of the sheets at one side of the pile; alignment elements located at least at an upper end of the pile and exerting alignment forces on the pile towards the front and the side stops; loosening means for neutralizing, at least partly, adherence of the upper sheets to one another; conveying means for withdrawing the respective uppermost sheet from the pile and feeding it into the printing machine; and additional sheet alignment means acting upon the surface of the respective uppermost sheet, at least until it is taken over by the conveying means, in a way that the alignment means exert alignment forces upon the sheet towards at least one of the stops; the additional sheet alignment means being offset with respect to the conveying means towards respective trailing edges of the sheets.

In order to enable the feeder according to the invention to be adapted readily, for example, to different kinds of paper and sheet formats, in accordance with other features of the invention, the additional sheet alignment means are adjustable with regard to a change in the direction, size and point of application of the resultant of the alignment forces exerted on the uppermost sheet.

In accordance with another feature of the invention, the additional sheet alignment means has a blowing device arranged above the sheet pile for separating the uppermost sheet from the pile by suction action and for producing an air flow directed almost tangentially to the pile surface and to at least one stop.

In accordance with a further feature of the invention, the blowing device has been provided with at least one blowing head displaceably mounted on a traverse extending parallel to the front stop and having a blowing nozzle swingable about a vertical axis, the blowing head being arrestable on the traverse in selective positions, and the blowing nozzle being arrestable in selective swivelled positions with respect to the vertical axis, and guides and guide means assigned thereto being provided, the guide means carrying the traverse for parallel displacement thereof and being arrestable with respect to the guides. The guide means which carry the traverse are provided for displacing the blowing device in longitudinal direction of the pile. In this regard, the point of application and the direction of action of the additional sheet alignment means altogether are selectable.

In the use of conventional measures, air under varying pressure can be fed to a blowing head so that the size of a resultant of the alignment forces exerted by the additional sheet alignment means on the sheet can also be varied.

In accordance with an added feature of the invention, an improved use of the alignment action of the addition sheet alignment means can be attained, especially by performing an alignment both in longitudinal as well as in a transverse direction.

In so doing, the separated sheet is pressed, at least with one of its edges to be aligned, by means of the additional sheet alignment means, against a stop formed by stop rolls. These stop rolls facilitate the sheet transport towards a second stop whereat another sheet edge is to be aligned under the effect of the additional sheet alignment means.

In this regard, in accordance with yet another feature of the invention, at least one stop is subdivided into a lower section with a vertical, planar stop surface merging into a substantially horizontal surface section along a small spacing below an upper edge of the sheet pile, and into an upper section adjoining the lower section, the upper section being formed of freely rotatable stop rolls having vertically disposed rotational axes and outer cylindrical surfaces removed from the planar stop surface by a spacing, as viewed in a direction towards the stop surface.

In accordance with a concomitant feature of the invention, each of the stop rolls has a lower outer cylindrical surface section freely penetrating a cutout formed in the substantially horizontal surface section.

A feeder according to the invention has the advantage that the sheets to be printed are supplied in register to the infeed rollers of a printing machine without requiring a feed table which would extend the total machine construction length.

The additional sheet alignment means align the respective uppermost sheet in register directly above the pile. In so doing, the sheet is held by the additional sheet alignment means in an aligned position until it is seized by the conveying means from above the pile and fed to the printing machine. In this case, even with an in-register sheet alignment, these conveying means do not have to perform a lateral movement.

Due to the action of the additional sheet alignment means upon the surface of the sheets, the cutting or dimensioning of the sheets within a wide tolerance range has no disadvantageous influence on the register accuracy of the print.

As a further advantage, due to the arrangement of the additional sheet alignment means so that they are offset with respect to the conveying means towards the trailing sheet edge, relatively short stroke cycles are possible because the arrangement permits an aligned first sheet to be transported into the machine while a second sheet lying under the first sheet is aligned simultaneously.

The feeder according to the invention also offers the further advantage that for the alignment of the individual sheets, no cycle-controlled alignment means and especially no alignment means which moves in accordance with the machine cycle, such as, side pull lays or suction means, for example, which transport the sheet against a stop arranged at a distance laterally from the pile, are needed.

With known feeders the separation from the pile of the sheets to be printed occurs especially by means of loosening blowers which are arranged at especially suitable pile locations.

According to the aforementioned advantageous embodiment of the invention, in which a blowing device is provided as an additional sheet alignment means, the separation effect caused by such loosening blowers can be attained, at least partly, by the additional sheet alignment means. In this regard, the blowing device produces a suction action which results from the air flow being almost tangential to the pile surface and which has a tendency to separate the uppermost sheet from the pile.

Other features which are considered as characteristic for the invention are set forth in the appended claims.

Although the invention is illustrated and described herein as embodied in a sheet feeder for a printing machine, it is nevertheless not intended to be limited to the details shown, since various modifications and structural changes may be made therein without departing from the spirit of the invention and within the scope and range of equivalents of the claims.

Figure 2:
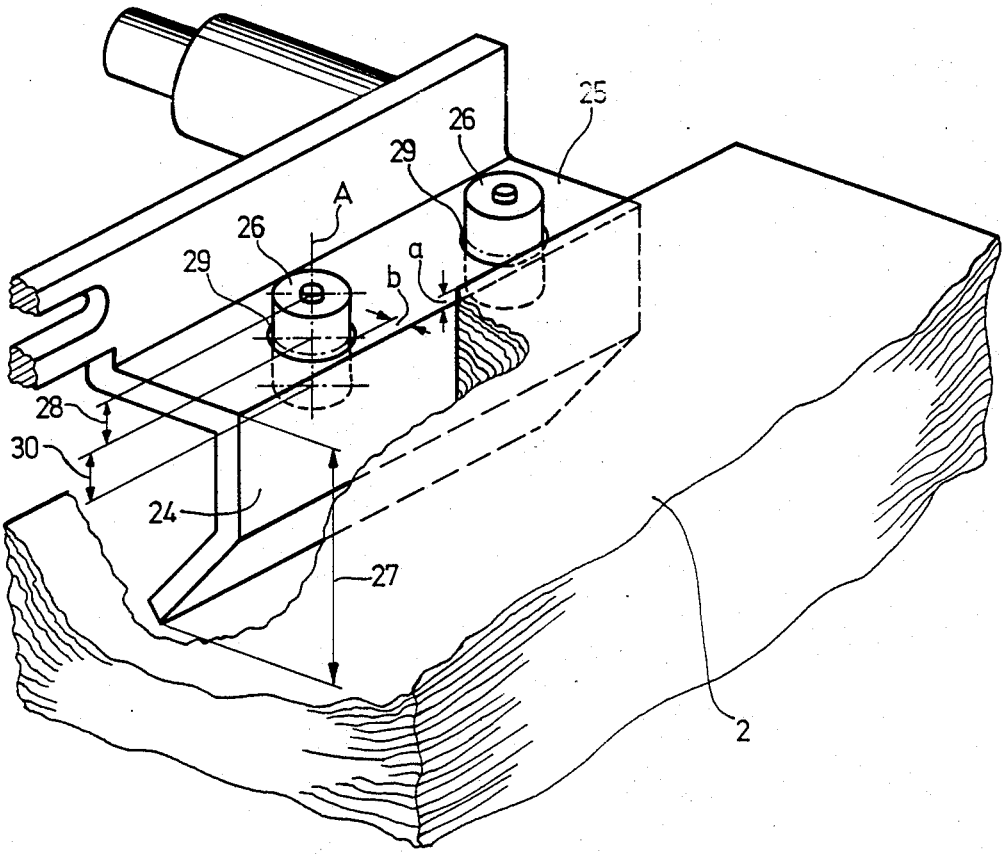

The construction and method of operation of the invention, however, together with additional objects and advantages thereof will be best understood from the following description of specific embodiments when read in connection with the accompanying drawings, in which:

FIG. 1 is a diagrammatic top, rear and side perspective view of a feeder according to the invention; and FIG. 2 is a fragmentary enlarged view similar to that of FIG. 1 showing another embodiment of the feeder having a stop formed with a stop surface and stop rolls.

Referring now to the drawing and first particularly to FIG. 1 thereof, there is shown a receiving or take-up device 1, which is adjustable in height, for a pile 2 formed of individual sheets. The adjustability in height is indicated herein by the provision of a vertical guide rod 3. A front stop 4 is provided for the leading edges of the sheets. Separator springs 5 are assigned to the stop 4 for reliably separating the uppermost sheet from the pile 2. The upper sheets are loosened by blower nozzles 6 which are directed towards the upper region of the front or leading-edge side of the pile and by means of additional non-illustrated blowers arranged at suitable locations of the pile 2.

The pile 2 is aligned in the upper region thereof between the front stop 4 and a rearward alignment means in the form of a leaf spring 7, and between a side or lateral stop 8 and an opposing lateral or side alignment means, also in the form of a leaf spring 9.

For setting the format in transverse direction of the pile 2, the side stop 8 and a holder support 10 for the leaf spring 9 are displaceably mounted on rods 11, 12.1 and 12.2, which are inserted in non-illustrated side walls, and are arrestable by suitable non-illustrated arresting means in a position corresponding to the respective pile width. The leaf spring 9 is displaceable with respect to the support 10 in longitudinal direction of the pile 2 and can be fixed in place by screws 13. The rearward leaf spring 7 is adjustable in longitudinal direction of the pile 2 and can be fixed in place by means of a screw connection 14 on a support 15 which is fastened to the rod 11.

In a forward region of the pile 2, there are arranged conveying means 16 which are illustrated fragmentarily in simplified form. The conveying means 16 seize the separated uppermost sheet by means of suction heads and feed it to the printing machine.

Opposite the conveying means 16 and offset towards the trailing sheet edge 17 is a blowing head 18 which is provided as an additional sheet alignment means. The blowing head 18 has a blowing nozzle 19 which is swingable about a vertical axis and which is mounted so as to be displaceable in longitudinal direction on a traverse 20 extending parallel to the front stop 4.

The traverse 20 is carried by guide means 21 which are, in turn, displaceable with respect to a guide 22, the traverse 20 thus performing a parallel displacement.

The blowing nozzle 19 is arranged so as to be displaceable in longitudinal and transverse directions of the pile 2 and so as to be swingable about a vertical axis. It can be fixed in a respective selected position by means of suitable arresting means otherwise not shown in detail in FIG. 1.

The blowing head 18 is supplied via a blowing air union or connection 23 with compressed air which can be adjusted to different degrees of pressure by conventional means.

The blowing nozzle 19 is constructed so that, above the surface of the uppermost sheet, it produces an air flow which is nearly tangential to that surface. The air flow, on the one hand, causes a suction effect which acts to loosen or separate the uppermost sheet from the pile 2 and, on the other hand, exerts an alignment force on the sheet, the alignment force acting on one or both stops, depending upon the swung or swivelled position of the blowing nozzle 19.

Thus, the resultant alignment force is adjustable with respect to its point of application, its direction and size due to the aforementioned adjustability of the blowing nozzle 19 and by means of the compressed air supplied under varying pressure.

Instead of a single blowing head 18, it is also possible to provide a number of blowing heads which may be mounted e.g. on one and the same traverse in the aforedescribed manner or on respective traverse extending parallel to one another.

The inventive mode of action, namely holding the respective uppermost sheet in its aligned position by the additional sheet alignment means at least until the sheet is taken over by the conveying means, is achieved in the aforedescribed embodiment by merely connecting the blowing air connection or union 23 to a source of compressed air with constant pressure. A steady alignment force is thereby applied to the surface of the respective sheet located under the blowing head 18.

The alignment force acts initially upon the uppermost sheet not yet taken up by the conveying device which operates in accordance with the machine cycle or rhythm and then on the next following sheet even while the uppermost sheet is being transported. Thus, the conveying device takes over an aligned sheet with each machine cycle, even though the additional sheet alignment means are not cycle-controlled.

The fragmentary view of a feeder illustrated in FIG. 2 shows a further development of the invention insofar as the aligning action of the additional sheet alignment means is utilized more efficiently by reducing the resistance acting against an alignment movement of a sheet, especially if the sheet already abuts a first stop and is moved alongside that stop to a second stop positioned perpendicularly to the first mentioned stop.

For this purpose, the first stop is subdivided into a lower section 27 and an upper section 28. The lower section 27 has a vertical, flat stop surface 24 which, along a small spacing a below the upper edge of the pile 2, merges into a substantially horizontal surface section 25.

The upper section 28 of this stop is formed of freely rotatable stop rolls 26 with vertical rotational axes A. These stop rolls 26 are arranged so that their outer cylindrical surfaces are removed by a small spacing b from the edge on which the vertical stop surface 24 and the horizontal surface section 25 mutually border.

To ensure that the sheet abuts securely on the outer cylindrical surfaces of the stop rolls 26, cutouts or recesses 29 are provided in the lower section 27 of the first stop, each of the cutouts 29 being freely penetrated by a lower outer cylindrical surface section 30 of the stop rolls 26.

The stop rolls 26 are rather easily rotatable and thus facilitate a movement of a sheet abutting these rolls 26 in a direction alongside the stop formed by the stop rolls 26 if the sheet is also aligned by the additional sheet alignment at a sheet edge disposed perpendicularly to the aligned edge.

The foregoing is a description corresponding in substance to German Application P 37 06 058.9, dated Feb. 25, 1987, the International priority of which is being claimed for the instant application, and which is hereby made part of this application. Any material discrepancies between the foregoing specification and the aforementioned corresponding German application are to be resolved in favor of the latter.

I claim:

1. Sheet feeder for a printing machine comprising a receiving device adjustable in height for taking up a pile formed of individual sheets, a front stop for leading edges of the sheets, and at least one side stop for the side edges of the sheets at one side of a space wherein a pile is receivable; alignment elements located at least at an upper end of the pile-receiving space and having means located outside the pile-receiving space for adjusting said alignment elements so as to exert alignment forces on the pile towards the front and the side stops;

loosening means for neutralizing, at least partly, adherence of the upper sheets to one another; conveying means for gripping and withdrawing the respective uppermost sheet from the pile and feeding it into the printing machine; and additional sheet alignment means acting upon an upper surface of the respective uppermost sheet, at least until it is gripped by the conveying means, in a way that said alignment means exert alignment forces upon the sheet towards at least one of said stops; said additional sheet alignment means being offset with respect to the conveying means towards respective trailing edges of the sheets.

2. Sheet feeder according to claim 1, wherein said additional sheet alignment means are adjustable with respect to a change in the direction of a resultant of the alignment forces exerted upon the sheet.

3. Sheet feeder according to claim 1, wherein said additional sheet alignment means are adjustable with respect to a change in the size of the resultant of the alignment forces exerted upon the sheet.

4. Sheet feeder according to claim 1, wherein said additional sheet alignment means are adjustable with respect to a change in the point of application of the resultant of the alignment forces exerted upon the sheet.

5. Sheet feeder according to claim 1, wherein said additional sheet alignment means has a blowing device arranged above the sheet pile for separating the uppermost sheet from the pile by suction action and for producing an air flow directed almost tangentially to the pile surface and to at least one stop.

6. Sheet feeder for a printing machine comprising a receiving device adjustable in height for taking up a pile formed of individual sheets, a front stop for leading edges of the sheets, and at least one side stop for the side edges of the sheets at one side of the pile; alignment elements located at least at an upper end of the pile and exerting alignment forces on the pile towards the front and the side stops;

loosening means for neutralizing, at least partly, adherence of the upper sheets to one another; conveying means for withdrawing the respective uppermost sheet from the pile and feeding it into the printing machine; and additional sheet alignment means acting upon the surface of the respective uppermost sheet, at least until it is taken over by the conveying means, in a way that said alignment means exert alignment forces upon the sheet towards at least one of said stops; said additional sheet alignment means being offset with respect to the conveying means towards respective trailing edges of the sheets, wherein said additional sheet alignment means has a blowing device arranged above the sheet pile for separating the uppermost sheet from the pile by suction action and for producing an air flow directed almost tangentially to the pile surface and to at least one stop, said blowing device has at least one blowing head displaceably mounted on a traverse extending parallel to said front stop and having a blowing nozzle swingable about a vertical axis, said blowing head being arrestable on said traverse in selective positions, and said blowing nozzle being arrestable in selective swivelled positions with respect to said vertical axis; and wherein guides and guide means assigned thereto are provided, said guide means carrying said traverse for parallel displacement thereof and being arrestable with respect to said guides.

7. Sheet feeder for a printing machine comprising a receiving device adjustable in height for taking up a pile formed of individual sheets, a front stop for leading edges of the sheets, and at least one side stop for the side edges of the sheets at one side of the pile; alignment elements located at least at an upper end of the pile and exerting alignment forces on the pile towards the front and the side stops;

loosening means for neutralizing, at least partly, adherence of the upper sheets to one another; conveying means for withdrawing the respective uppermost sheet from the pile and feeding it into the printing machine; and additional sheet alignment means acting upon the surface of the respective uppermost sheet, at least until it is taken over by the conveying means, in a way that said alignment means exert alignment forces upon the sheet towards at least one of said stops; said additional sheet alignment means being offset with respect to the conveying means towards respective trailing edges of the sheets, at least one stop is subdivided into a lower section with a vertical, planar stop surface merging into a substantially horizontal surface section along a small spacing below an upper edge of the sheet pile, and into an upper section adjoining said lower section, said upper section being formed of freely rotatable stop rolls having vertically disposed rotational axes and outer cylindrical surfaces removed from said planar stop surface by a spacing, as viewed in a direction towards said stop surface.

8. Sheet feeder according to claim 7, wherein each of said stop rolls has a lower outer cylindrical surface section freely penetrating a cutout formed in said substantially horizontal surface section.

* * * * *